United States Patent [19]

Bartholomew et al.

[11] Patent Number: 4,730,560

[45] Date of Patent: Mar. 15, 1988

[54] COMBINATION BLASTING SIGNAL TRANSMISSION TUBE CONNECTOR AND DELAY ASSEMBLY

[75] Inventors: Stephen W. Bartholomew, Granby, Conn.; Daniel C. Rontey, Lebanon, N.J.; William J. Necker, Collinsville; Clifford N. Kaiser, Granby, both of Conn.

[73] Assignee: The Ensign-Bickford Company, Simsbury, Conn.

[21] Appl. No.: 914,822

[22] Filed: Oct. 3, 1986

[51] Int. Cl.[4] ..... C06C 5/04

[52] U.S. Cl. ..... 102/275.3; 102/275.5; 102/275.7; 102/275.12; 102/322

[58] Field of Search ..... 102/322, 275.3, 275.5, 102/275.7, 275.8, 275.9, 275.12

[56] References Cited

U.S. PATENT DOCUMENTS

| | | | |
|---|---|---|---|
| 2,707,438 | 5/1955 | Mann et al. | 102/27 |
| 2,736,263 | 2/1956 | Lewis et al. | 102/27 |
| 2,891,476 | 6/1959 | Forsyth | 102/27 |
| 3,306,201 | 2/1967 | Noddin | 102/27 |
| 3,343,487 | 9/1967 | Hare, Jr. et al. | 102/27 |
| 3,353,485 | 11/1967 | Miller et al. | 102/27 |
| 3,727,552 | 4/1973 | Zakheim | 102/27 |
| 4,215,631 | 8/1980 | Rucker | 102/275.5 |
| 4,424,747 | 6/1984 | Yunan | 102/275.2 |
| 4,481,884 | 11/1984 | Yunan | 102/313 |

FOREIGN PATENT DOCUMENTS

| | | |
|---|---|---|
| 731108 | 3/1953 | United Kingdom . |
| 726295 | 8/1953 | United Kingdom . |

*Primary Examiner*—Peter A. Nelson

*Attorney, Agent, or Firm*—Hayes & Reinsmith

[57] ABSTRACT

A combination signal transmission tube connector and delay assembly having a housing; means on the housing for engaging at least one signal transmission tube; means on the housing for cutting the transmission tube to expose at least two transmission tube interior portions; a signal delay assembly mounted in the housing for interposition between exposed transmission tube interior portions; and means on the housing for establishing a signal path permitting signal communication between the delay assembly and exposed transmission tube interior portions. The delay assembly preferably has a delay element containing a shaped composition having a preselected combustion time from one side of said element to another side of said element; and at least two transition elements adjacent to the delay element for transferring a signal between the delay element and exposed transmission tube interior portions, each of the transition elements containing a shaped transition composition.

17 Claims, 6 Drawing Figures

COMBINATION BLASTING SIGNAL TRANSMISSION TUBE CONNECTOR AND DELAY ASSEMBLY

BACKGROUND OF THE INVENTION

This invention relates to a combination connector and time delay assembly for blasting signal transmission tube.

In detonating a plurality of blasting charges it is often required that the timing of such detonations be controlled precisely. This is true, for example, in blasting quarries where sequential delays between charges must be controlled within milliseconds. In order to control such timing of charges, transmission lines are deployed from a central initiating point to send a signal to detonate the individual blasting charges. Normally, these lines consist of one or more main trunk lines connected to a plurality of down lines.

Timing of the detonating signal is normally accomplished by using preselected lengths of known signal velocity transmission lines, and by utilizing signal delay units where necessary.

The manner of connection of the signal transmission lines, for example, between a trunk lines and a plurality of down lines, depends on the type of transmission line utilized. Conventional destructing combustible fuses and detonation cords may be connected by tying together the line ends. In some cases supplementary charges are utilized to assure that the signal is transmitted. A supplementary charge device is as disclosed in U.S. Pat. No. 4,481,884. Where additional delay time is required, a delay unit may be utilized, for example, as disclosed in U.S. Pat. No. 2,736,263.

Non-destructing transmission tubes may also be utilized to carry a detonating signal, for example, as disclosed in U.S. Pat. No. 3,590,739. The detonating signal transmission tube disclosed therein is sold under the trademark "Nonel" and is sometimes referred to as "shock tube". As used herein, there term "signal transmission tube" refers to any detonating or deflagrating signal transmission line comprising a flexible hollow tube which can carry a detonating or deflagrating signal along its interior, which signal does not destroy the tube. Such signal transmission tube may be any of the different available tubes, for example, shock tube having a detonating powder coated on the inner periphery of the tube, as disclosed in the aforementioned U.S. Pat. No. 3,590,739, transmission tube containing a combustible gas within the hollow tube, transmission tube containing a combustible substance carried on a line inside the tube, or a transmission tube having a deflagrating substance coated on the inside of the tube as disclosed in co-pending U.S. patent application Ser. No. 811,731 assigned to the assignee of the present application.

The term "signal" when used in connection with the aforementioned transmission tube is intended to refer to both the detonating shock wave or deflagrating flame front which is transmitted along the interior of the shock tube by combustion of the reactive substances contained therein.

Separate lines of signal transmission tube have been conventionally connected by utilizing a separate active element between adjacent tube ends, for example, a blasting cap, or by utilizing simple nipple-type connectors, for example, as disclosed in the aforementioned co-pending application Ser. No. 811,731. The use of active elements in signal transmission tube connectors may be unsatisfactory because of noise restrictions. The nipple-type connectors have also been unsatisfactory because of the restriction in cross-sectional area for transmission.

Conventional delay elements have not been suitable for use with shock tube because of the low intensity of the incoming transmission tube signal and problems in creating an outgoing transmission tube signal.

The low transmission tube signal intensity also causes problems in connecting the tubes. Unless the transmission tube signal is carefully directed and controlled, it may dissipate as it passes from one tube to another and fail to initiate a signal in the second tube. In addition, the presence of contaminating elements such as water may cause the signal to dissipate. As a result, field connections of signal transmission tubes have heretofore been unsatisfactory.

It is therefore an object of the present invention to provide an improved means for connecting a delay assembly to signal transmission tube.

It is another object of the present invention to provide a means for connecting a delay assembly to signal transmission tube which has improved reliability.

It is a further object of the present invention to provide a means for connecting a delay assembly to signal transmission tube which may be practiced under adverse environmental conditions.

It is yet another object of the present invention to provide a means for connecting a delay assembly to a signal transmission tube which is low in cost and essentially disposable.

It is another object of the present invention to provide a means for connecting a delay assembly to signal transmission tube which may easily be utilized in less-skilled field installations.

Other objects will be in part obvious and in part pointed out in more detail hereinafter.

A better understanding of the objects, advantages, features, properties and relations of the invention will be obtained from the following description and accompanying drawings which set forth certain illustrative embodiments and are indicative of the various ways in which the principles of the invention are employed.

SUMMARY OF THE INVENTION

The present invention comprises a combination signal transmission tube connector and delay assembly having a housing; means on the housing for engaging at least one signal transmission tube; means on the housing for cutting the transmission tube to expose at least two transmission tube interior portions; a signal delay assembly mounted in the housing for interposition between exposed transmission tube interior portions; and means on the housing for establishing a signal path permitting signal communication between the delay assembly and exposed transmission tube interior portions. The delay assembly preferably has a delay element containing a shaped composition having a preselected combustion time from one side of said element to another side of said element; and at least two transition elements adjacent to the delay element for transferring a signal between the delay element and exposed transmission tube interior portions, each of the transition elements containing a shaped transition composition.

DETAILED DESCRIPTION OF THE INVENTION

The nature of the transmission tube signal is such that, in practicing the present invention, attention must be paid to the positioning of the signal transmission tubes and delay assembly, the distance between the delay assembly and the transmission tube openings exposing the reactive interior portions, and the degree of enclosure about the path between the delay assembly and the signal transmission tube openings. In general, for signal communication to take place between a transmission tube and a delay assembly, the degree of enclosure necessary about the path between the delay assembly and the transmission tube openings is inversely proportional to the spacing therebetween i.e., a close spacing has less need for enclosure while a relatively large spacing requires a large degree of enclosure. Beyond a certain spacing, there can be no signal communication between signal transmission tubes and a signal delay assembly, regardless of the degree of enclosure.

Interior-exposing openings to a signal transmission tube may be made either by severing the tube completely to present a tube free end or by cutting away only a portion of the tube wall at some intermediate point between the tube ends. The size of the opening in the latter instance must be large enough to permit signal communication either into or out of the opening. The proper tube opening size for a particular application may be determined by simple experimentation.

The signal transmission tube is preferably secured in place in the combination connector and delay assembly of the present invention by means engaging the exterior of the tube, although auxilliary guide means may be employed which engage portions of the tube interior at the tube openings. The signal transmission tube securing means should be able to withstand the longitudinal forces created by the transmission tube signal entering or leaving the transmission tube opening, or applied in handling.

Embodiments of the combination signal transmission tube connector and delay assembly of the present invention are illustrated in FIGS. 1–5. Like identifying numerals are used throughout the figures to identify like features. With the exception of the cutting means and delay assembly itself, to be described hereinafter, the combination connector and delay assembly is preferably made from a plastic or the like.

Figure 1:
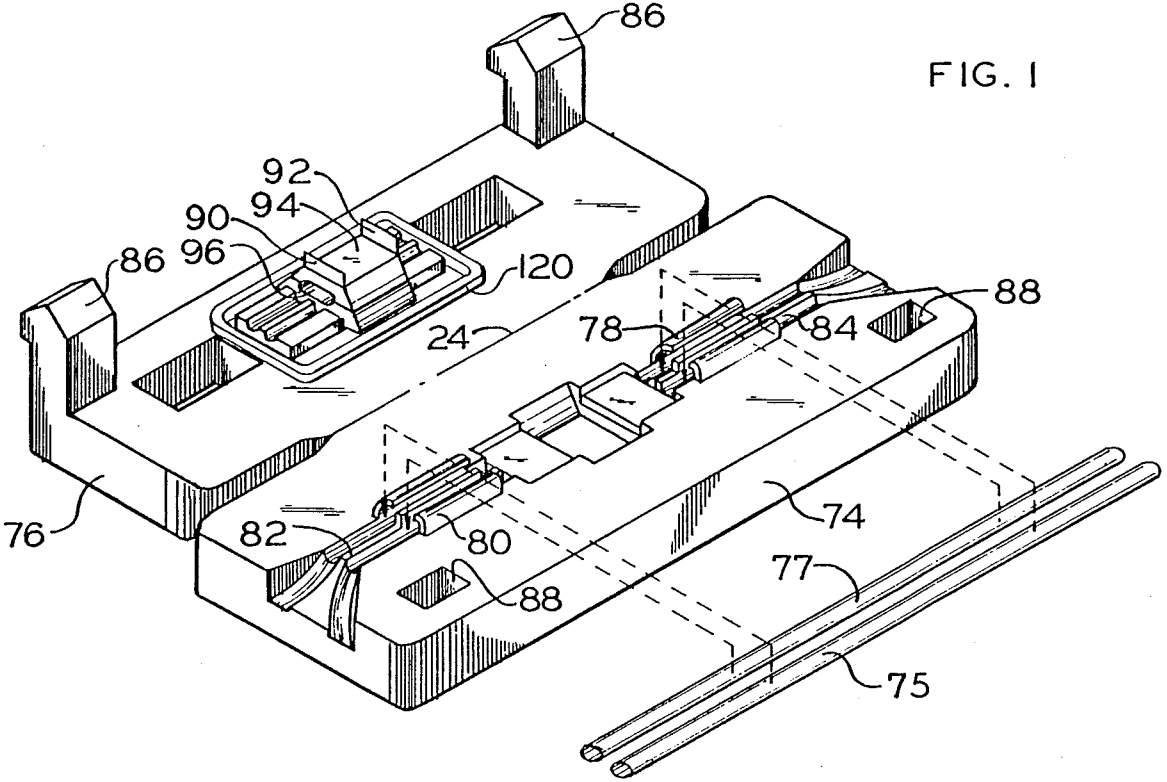
FIG. 1 is partially exploded perspective view of a first embodiment of the combination transmission tube connector and delay assembly of the present invention.
Figure 2:
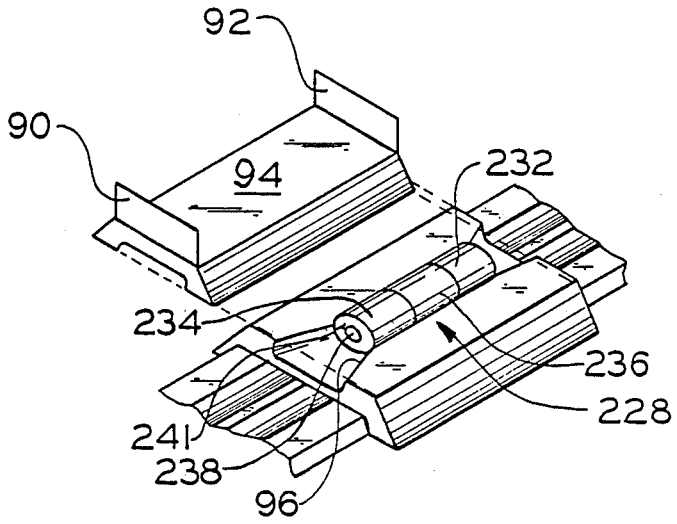
FIG. 2 is a partially exploded perspective view of a portion of the embodiment of FIG. 1.
Figure 3:
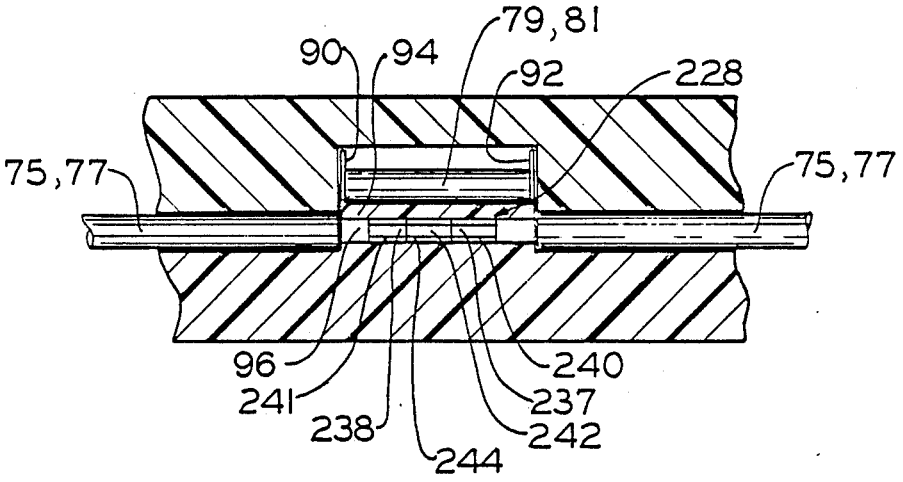
FIG. 3 is a longitudinal cross-sectional view of a portion of the embodiment of FIG. 1 in a closed position.

A first embodiment of the present invention is shown in FIGS. 1, 2 and 3. In the open position illustrated in FIG. 1, a split housing comprises sections 74, 76 joined by hinge 24, two pairs of clips 78, 80 for receiving and securing signal transmission tubes 75, 77 in tube slots 82 and 84, and snaps 86 for securing housing sections 74 and 76 in a closed position. The snaps cooperate with holes 88 to guide and properly locate the housing sections 74, 76 during closing. The cutting means in this embodiment comprises two knife-edged blades 90 and 92 longitudinally spaced along the path of the shock tubes when they are positioned in the housing clips 78 and 80. The blades 90 and 92 are fixed to a raised cutblock 94 on housing section 76 such that closing of housing section 76 over transmission tubes 75, 77 received in slots 82, 84 causes the blades 90, 92 to sever each tube in two longitudinally spaced locations.

Instead of servering individual tube lengths 75, 77 as illustrated in FIG. 1, the ends of two separate tube lengths can be substituted for one or both individual tube lengths by abutting the ends of the separate tube lengths between blades 90, 92.

As seen in FIG. 3 in a partial cross-section of the closed housing, the severed tube segments 79, 81 remain between the blades 90 and 92 and no longer form a part of the connection between the signal transmission tubes 75, 77. The cutblock 94 contains a chamber 96 below the blades and aligned directly in the path of the shock tubes when the housing is closed. The severed ends of the incoming and outgoing shock tubes are positioned directly adjacent to the cutblock chamber 96, which chamber contains delay assembly 228 to effect a predetermined time delay to signal communication between the interior signal propagating reactive regions of the now severed portions of signal transmission tubes 75, 77.

As shown in FIG. 2, the delay assembly 228 and channel 96 are both cylindrical in shape and are correspondingly configured to fit tightly together. The tight fit prevents direct transmission tube signal communication between opposing signal transmission tubes which would bypass the delay assembly. The delay assembly 228 comprises signal transition elements 232, 234 on either side of a delay element 236.

In approximately central location in the delay assembly 228 is a conventional delay element 236 containing a shaped delay composition 242 inside a lead tube 244. The delay composition may be of any known in the art, for example a mixture of silicon and lead dioxide ($PbO_2$); silicon and red lead oxide ($Pb_3O_4$); silicon, red lead oxide ($Pb_3O_4$); and antimony trisulfide ($Sb_2S_3$); tungsten, potassium perchlorate ($KClO_4$) and barium chromate ($BaCrO_4$); molybdenum and potassium perchlorate ($KClO_4$); and mixtures thereof.

The delay element functions to control combustion time from one side of the element to the other. This combustion time is preselected by the user and any range from nine (9) milliseconds to ten (10) seconds or longer, depending on the delay composition utilized.

On either side of the delay element 236 are signal transition elements 232, 234 containing a shaped transition composition 237, 238 packed inside lead tubes 240, 241, respectively. The transition elements 232, 234 are positioned directly adjacent to the delay element 236 to receive and transmit a blasting initiation signal between the severed signal transmission tubes 75, 77 through the delay element.

The transition elements 232 or 234 function to transmit an incoming signal from a signal transmission tube to one side of the delay element. Once the signal has been transmitted through the delay element 236, the transition element 234 or 232 on the opposite side of delay element 236 transmits the signal to another transmission tube. Thus, the transition element has a dual input/output function and the combination connector and delay assembly, as illustrated, may be bidirectional.

In the embodiment shown in FIGS. 1, 2 and 3, transmission tube signal propagation would not be delayed between transmission tube ends on the same end of delay assembly 228.

The transition element utilized in the delay assembly and method of the present invention contains a shaped, finely granulated transition composition. As used herein, the term "transition composition" refers to a mixture of oxidizing and reducing agents which exothermically react to produce sufficient heat energy to ignite a signal in a signal transmission tube, and which may also be ignited by a signal from a signal transmission tube to react exothermally. The aforedescribed delay compositions will not function as a transition composition. Suitable transition compositions include a mixture of zirconium and potassium perchlorate ($KClO_4$), a mixture of titanium and potassium perchlorate ($KClO_4$), a mixture of boron and red lead oxide ($Pb_3O_4$), a mixture of zirconium and iron (III) oxide ($Fe_2O_3$), a mixture of zirconium and potassium chlorate ($KClO_3$), a mixture of zirconium and lead chromate ($PbCrO_4$), a mixture of titanium and lead chromate ($PbCrO_4$), a mixture of magnesium and barium chromate ($BaCrO_4$), a mixture of boron and potassium nitrate ($KNO_3$), and mixtures thereof.

The transition composition components are first finely pulverized by conventional means, admixed and then shaped, for example, by pressing to a desired form. The mixed transition composition is optionally mixed with a binder, for example, a polyester resin, before shaping. Preferably the mixed transition composition is packed in a metal tube, for example, lead, which is then drawn down to a smaller diameter. The transition element may then be made by cutting lengths of the transition composition-containing tube.

The transition composition 237 in transition element 232 may be the same as or may be different from the transition composition 238 in transition element 234.

Since the purpose of the delay assembly is to delay signal propagation between the signal transmission tubes connected thereto, the delay element and transition elements must be fitted into the housing to prevent signal bypassing.

In normal operation, an incoming signal will be transmitted from a signal transmission tube to a first transition element in the form of a pulsed shock wave or a flame front. The incoming signal initiates combustion of a first transition composition. Combustion of the first transition composition from the transmission tube side to the delay element side occurs preferably in less than about 35 milliseconds. The combustion of the transition composition then ignites the first side of the delay element. The delay element delaying composition will effect combustion from one side of the element to another side in a preselected time ranging typically up to ten (10) seconds, depending on the particular delay element and composition employed. At the end of the preselected delay element combustion time, a second transition element will be ignited. Combustion of the second transition element will then initiate a signal in an outgoing signal transmission tube and cause that signal to be propogated therein in a direction away from the delay element.

A gasket 120 may be disposed in housing section 74 or 76 surrounding the cutblock 94 region to provide an environmental seal when the housing is closed. This environmental seal restricts infiltration of water and other contaminants into the region surrounding the delay assembly 228 and severed tubes 75, 77. Such contaminants, if allowed into the chamber, may interfere with signal communication between the signal transmission tubes and delay assembly.

The connector may also incorporate an absorbent or dessicating material in the housing chamber to prevent contaminating materials which may be present from interfering with signal communication, for example, if the connector is used in the field on a rainy day. Where water is the primary contaminant, the use of absorbant paper is preferred.

Figure 5:
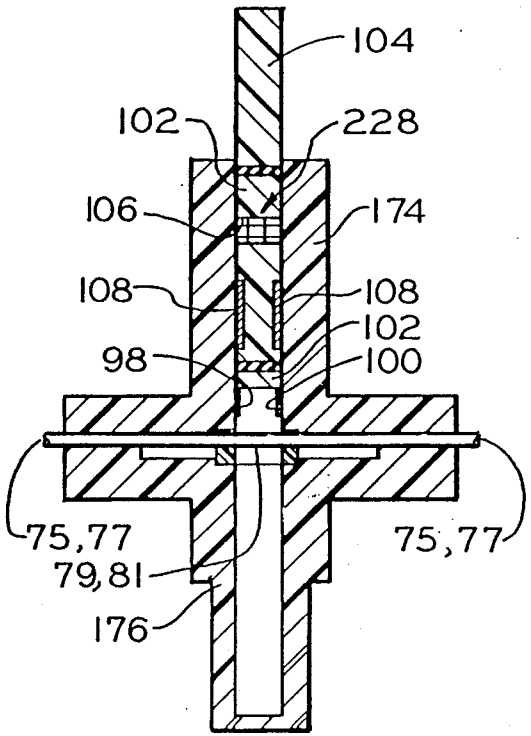
FIG. 5 is a cross-sectional view of the embodiment of FIG. 4.
Figure 4:
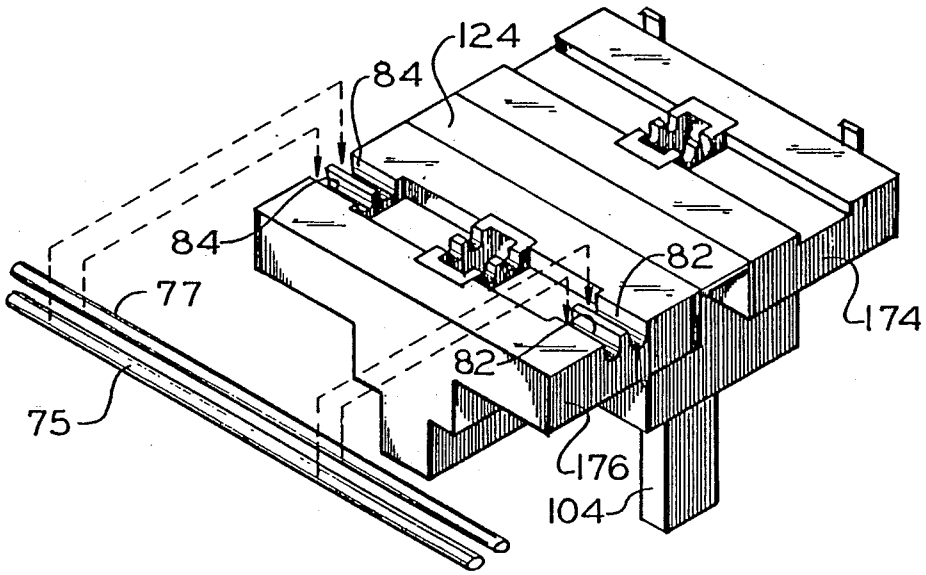
FIG. 4 is a partially exploded perspective view of a second embodiment of the combination transmission tube connector and delay assembly of the present invention.
Figure 6:
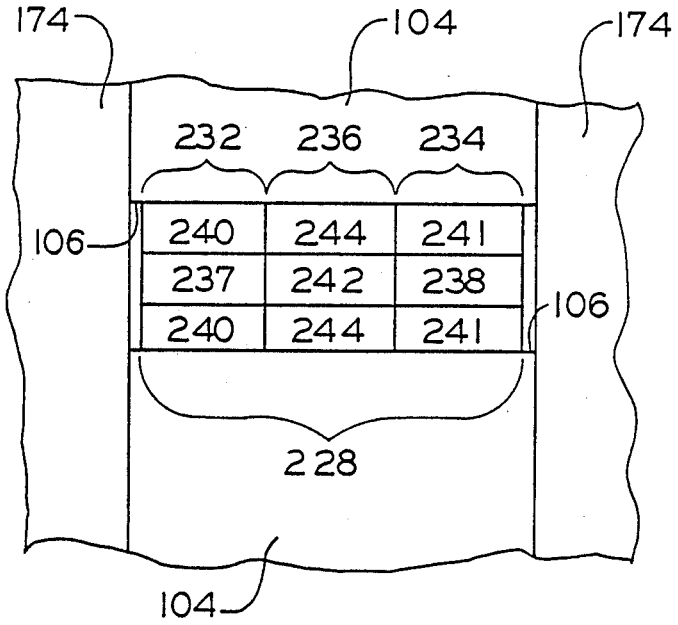
FIG. 6 is a cross-sectional view of a portion of the embodiment shown in FIG. 5.

In FIGS. 4, 5 and 6 there is shown a second embodiment of the combination connector and delay assembly of the present invention, which is a modification of the first embodiment. As seen in the open position in FIG. 4, housing sections 174, 176 again are joined by hinge or tether 124, and contain slots 82, 84 for securing signal transmission tubes 75, 77 in adjacent relationship. Any conventional fastening means may be employed for securing the housing members in a closed position. A pair of knife-edge blades 98, 100 are fixed on a cutblock 102 in a transverse position to the path of the transmssion tube. However, unlike the previous embodiment, the cutblock 102 of this second embodiment is mounted on a shaft 104 which is linearly slidable in a direction perpendicular to the path of the signal transmission tubes 75, 77 and the blade knife edge. The shaft 104 extends through housing section 174 and is operable from the housing exterior, when housing sections 174 and 176 are closed, between a retracted position where the blades are drawn away from housing section 176 and a projected position where the blades are advanced toward housing 176.

After the housing is closed, as shown in FIG. 5, the blades 98, 100 may be projected to cross the path of the transmission tube 75, 77 and so operate to sever a segment 79, 81 from the adjacent secured transmission tubes. A chamber 106 in the cutblock 102 above the blades 98, 100 is aligned with the signal transmission tube path as the shaft cutblock assembly is extended into its advanced position. Chamber 106 contains delay assembly 228 to provide a predetermined signal delay between the severed ends of transmission tubes 75, 77. As shown more clearly in FIG. 6, delay assembly 228 is fitted tightly in chamber 106 to preclude a blasting initiation signal from bypassing the delay assembly. In operation, transition element 232 or 234 receives a signal from one side of transition tubes 75, 77, ignites delay element 236, which after a predetermined time ignites transmission element 234 or 232, and finally initiates a signal in the opposite side of transmission tubes 75, 77.

In the embodiment shown in these FIGS. 4, 5 and 6, contamination absorbent means 108, comprising absorbent paper, is affixed to the cutblock 102 between the blades 98 and 100 and the cutblock chamber 106. This paper 108 serves to absorb contaminating water from the region of the severed shock tube ends as the cutblock assembly is advanced.

While this invention has been described with reference to specific embodiments, it will be recognized by those skilled in the art that variations are possible without departing from the spirit and scope of the invention, and that it is intended to cover all changes and modifications of the invention disclosed herein for purposes of illustration which do not constitute departure from the spirit and scope of the invention.

Having thus described the invention, what is claimed is:

1. A combination signal transmission tube connector and delay assembly comprising:

a housing;

means on said housing for engaging at least one signal transmission tube;

means on said housing for cutting said transmission tube to expose at least two transmission tube interior portions;

a signal delay assembly mounted in said housing for interposition between exposed transmission tube interior portions; and means on said housing for establishing a signal path permitting signal communication between said delay assembly and exposed transmission tube interior portions.

2. The combination of claim 1 wherein said housing comprises first and second members operable between an open position permitting insertion of said signal transmission tube and a closed position permitting signal communication between said delay assembly and exposed transmission tube interior portions.

3. The combination of claim 2 wherein said first and second members are joined by a hinge.

4. The combination of claim 2 further comprising means for enviornmentally sealing said exposed transmission tube interior portions from the housing exterior.

5. The combination of claim 4 wherein said environmental sealing means comprises a gasket between said housing members.

6. The combination of claim 2 additionally comprising means for absorbing moisture from said engaged signal transmission tube.

7. The combination of claim 2 wherein said cutting means, said delay assembly, and said signal path means are operable to expose said transmission tube interior portions, interpose said delay assembly between exposed transmission tube interior portions, and permit signal communication between said delay assembly and exposed transmission tube interior portions, respectively, as said housing members are closed.

8. The combination of claim 2 wherein said cutting means, said delay assembly, and said signal path means are operable to expose said transmission tube interior portions, interpose said delay assembly between exposed transmission tube interior portions, and permit signal communication between said delay assembly and exposed transmission tube interior portions, respectively, after said housing members are closed.

9. The combination of claim 1 wherein said delay assembly comprises a delay element containing a shaped composition having a preselected combustion time from one side of said element to another side of said element; and at least two transition elements adjacent to said delay element for transferring a signal between said delay element and exposed transmission tube interior portions, each of said transition elements containing a shaped transition composition.

10. The combination of claim 9 wherein the transition composition is selected from the group consisting of a mixture of zirconium and potassium perchlorate, a mixture of titanium and potassium perchlorate, a mixture of boron and red lead oxide, a mixture of zirconium and iron oxide, a mixture of zirconium and potassium chlorate, a mixture of zirconium and lead chromate, a mixture of titanium and lead chromate, a mixture of magnesium and barium chromate, a mixture of boron and potassium nitrate, and mixtures thereof.

11. A combination signal transmission tube connector and delay assembly comprising:

a housing having first and second members operable between an open and closed position;

means on said housing for engaging at least one signal transmission tube in an open housing position means on said housing for cutting said transmission tube to expose at least two transmission tube interior portions;

a signal delay assembly mounted in said housing for interposition between exposed transmission tube interior portions, said delay assembly having a delay element containing a shaped composition having a preselected combustion time from one side of said element to another side of said element, and at least two transition elements adjacent to said delay element for transferring a signal between said delay element and exposed transmission tube interior portions, each of said transmission elements containing a shaped transition composition; and means on said housing for establishing a signal path in a closed housing position permitting signal communication between said delay assembly and exposed transmission tube interior portions.

12. The combination of claim 11 wherein said first and second members are joined by a hinge.

13. The combination of claim 11 further comprising a gasket between said first and second housing members for environmentally sealing said delay assembly and exposed transmission tube interior portions from the housing exterior.

14. The combination of claim 11 additionally comprising means for absorbing moisture from said engaged signal transmission tube.

15. The combination of claim 11 wherein said cutting means, said delay assembly, and said signal path means are operable to expose said transmission tube interior portions, interpose said delay assembly between exposed transmission tube interior portions, and permit signal communication between said delay assembly and exposed transmission tube interior portions, respectively, as said housing members are closed.

16. The combination of claim 11 wherein said cutting means, said delay assembly, and said signal path means are operable to expose said transmission tube interior portions, interpose said delay assembly between exposed transmission tube interior portions, and permit signal communication between said delay assembly and exposed transmission tube interior portions, respectively, after said housing members are closed.

17. The combination of claim 16 wherein the transition composition is selected from the group consisting of a mixture of zirconium and potassium perchlorate, a mixture of titanium and potassium perchlorate, a mixture of boron and lead oxide, a mixture of zirconium and iron oxide, a mixture of zirconium and potassium chlorate, a mixture of zirconium and lead chromate, a mixture of titanium and lead chromate, a mixture of magnesium and barium chromate, a mixture of boron and potassium nitrate, and mixtures thereof.

* * * * *